US005682005A

United States Patent [19]

Crowley

[11] Patent Number: 5,682,005

[45] Date of Patent: Oct. 28, 1997

[54] MISSILE CONTAINER SUPPORT RACK

[75] Inventor: David R. Crowley, Grand Prairie, Tex.

[73] Assignee: Loral Vought Systems Corporation, Grand Prairie, Tex.

[21] Appl. No.: 455,537

[22] Filed: May 31, 1995

[51] Int. Cl.[6] ..... F41F 3/00

[52] U.S. Cl. ..... 89/1.815; 89/1.801

[58] Field of Search ..... 89/1.801, 1.802, 89/1.804, 1.815; 206/317

[56] References Cited

U.S. PATENT DOCUMENTS

| | | | |
|---|---|---|---|
| 2,450,929 | 10/1948 | Ashworth | 89/1.801 |
| 3,106,132 | 10/1963 | Biermann et al. | 89/1.801 |
| 3,106,864 | 10/1963 | Seedlock et al. | 89/1.815 |
| 3,180,224 | 4/1965 | Linke | 89/1.815 |
| 3,303,740 | 2/1967 | Grayson et al. | 89/1.815 |
| 3,742,813 | 7/1973 | Kongelbeck | 89/1.815 |
| 3,981,224 | 9/1976 | Byars et al. | 89/1.815 |
| 4,470,336 | 9/1984 | Swann et al. | 89/1.815 |
| 5,020,412 | 6/1991 | Adams | 89/1.815 |
| 5,063,827 | 11/1991 | Williamson | 89/14.3 |

*Primary Examiner*—Michael J. Garone
*Assistant Examiner*—Theresa M. Webson
*Attorney, Agent, or Firm*—Sidley & Austin

[57] ABSTRACT

A rack system (10) is disclosed for use on a vehicle (12) which carries weapons containers (48, 50) containing one or more missiles or rockets (52). A crane mounted on the system pivots each weapons container independently from a storage position to a vertical launch position. Locking devices lock the weapons containers in the storage position for transport and in the vertical, launch position.

22 Claims, 11 Drawing Sheets

MISSILE CONTAINER SUPPORT RACK

TECHNICAL FIELD OF THE INVENTION

This invention relates to the carrying and deployment of missiles and rockets, and specifically to an improved system to move the weapons between a storage position and a launch position on a vehicle.

BACKGROUND OF THE INVENTION

An important component of modern warfare is the use of missile or rocket launchers on motorized vehicles. Use of the vehicles permit a launch to occur and the vehicles to be moved away from the site of the launch rapidly to avoid counter-battery fire.

In operation, speed and efficiency is critical. It is important to quickly and efficiently move the weapons from a storage position on the vehicle, usually horizontal to provide a low profile and center of gravity to the vehicle, to a launch position, which can either be at an angle between horizontal and vertical, or completely vertical depending on the weapon used.

It is also important to provide for reloading of the weapons system as rapidly as possible to maintain a continuous high rate of fire. Other important considerations include the desire for remote operation of the vehicle during launch to protect personnel in the event of counter-battery fire or failure of system components and a desire to reduce the power requirements of the system during use and provide failsafe systems in the event power systems fail.

An ongoing need exists for improved systems of this type which provide the advantages noted above.

SUMMARY OF THE INVENTION

In accordance with one aspect of the present invention, a rack system is provided for supporting a weapons container in a storage position and a launch position. The weapons container carries one or more missiles or rockets therein. The weapons container has a first side and a second side, a first end through which the missiles or rockets are launched, and an opposite, second end through which exhaust from the missiles or rockets is directed. The rack system includes a frame, a storage engagement structure to engage the weapons container proximate the first end in the storage position, a pivot engagement structure pivotally engaging the weapons container and a launch engagement structure to engage the weapons container in the launch position proximate the second end of the weapons container. The rack system further includes a crane mounted on the frame to pivot the weapons container about the pivot engagement structure to move the weapons container between the storage position and the launch position.

In accordance with another aspect of the present invention, the rack system includes a weapons container having at least one storage engagement pin mounted thereon proximate the first end, at least one pivot engagement pin mounted thereon and at least one launch engagement pin mounted thereon proximate the second end thereof. In accordance with another aspect of the present invention, the system includes a second launch engagement structure to engage the weapons container in the launch position.

In accordance with another aspect of the present invention, the storage engagement structure and the pivot engagement structure each include a block with a V notch therein. The storage engagement structure and the launch engagement structure further include hooks pivoted to the frame for engaging the weapons container, the hooks being connected by actuating links for simultaneous movement of the hooks.

In accordance with another aspect of the present invention, an improved weapons container is provided. The weapons container carries one or more missiles or rockets therein, the weapons container having a first end through which the missiles or rockets are launched and a second end through which exhaust is directed. The weapons container has at least one blast deflector mounted at the second end thereof formed by a curved sheet of material to redirect the exhaust. In accordance with another aspect, the weapons container is mounted on a vehicle, the blast deflector directing the exhaust away from the vehicle.

In accordance with another aspect of the present invention, a method is provided for deploying weapons in a weapons container from a storage position to a launch position. The weapons container carries one or more missiles or rockets therein and has a first end through which the missile or rocket is launched and an opposite, second end through which exhaust is directed. The method includes the steps of securing the weapons container in the storage position with a storage engagement structure on a frame engaging the weapons container proximate the first end of the weapons container, pivoting the weapons container about a pivot engagement structure on the frame between the storage position and the launch position and securing the weapons container in the launch position with a launch engagement structure mounted on the frame engaging the weapons container proximate the second end of the weapons container. The method further includes the step of pivoting the weapons container from the storage position to the launch position with a crane mounted on the frame.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION

Figure 1:
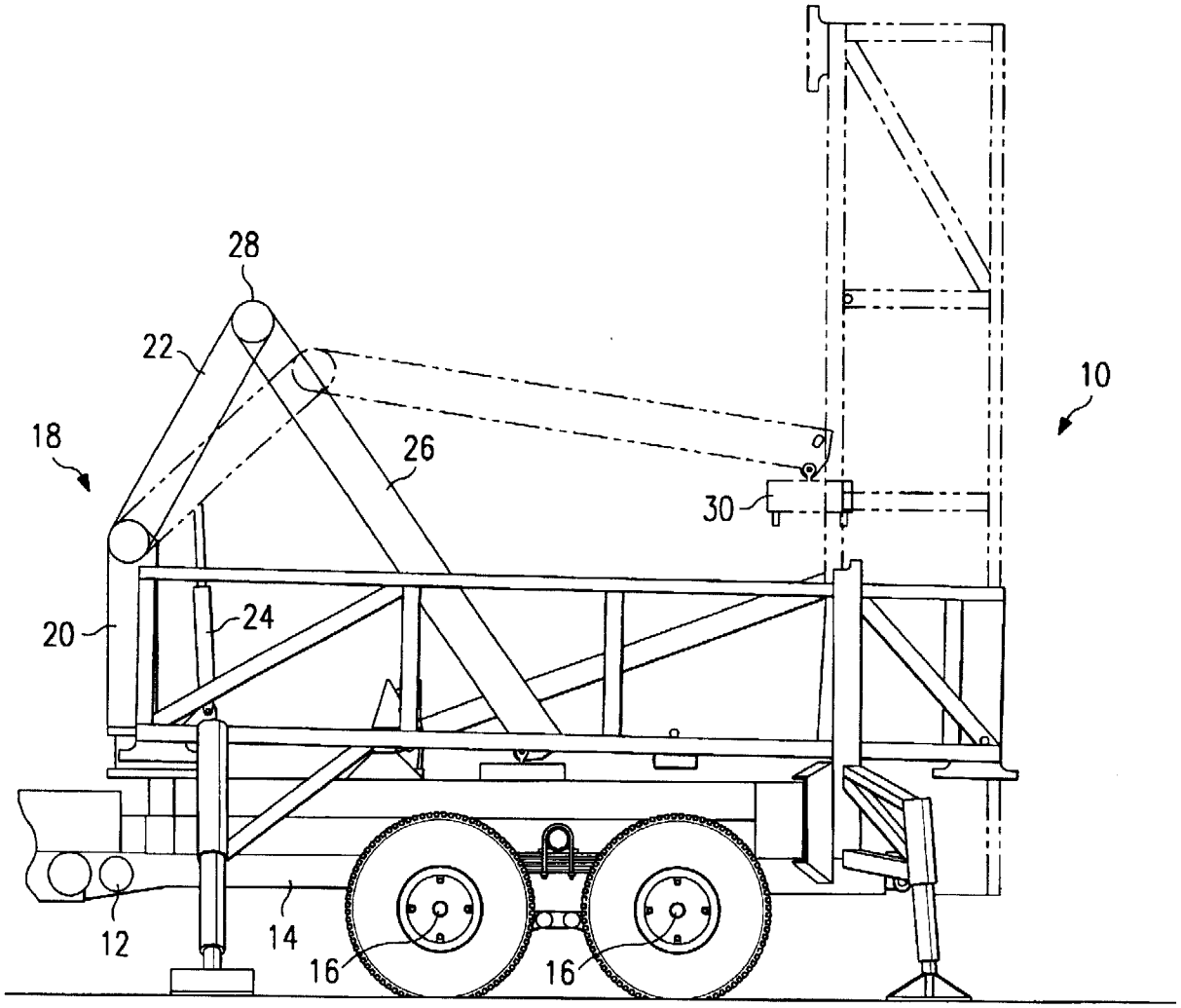
FIG. 1 is a side view of a vehicle system forming a first embodiment of the present invention illustrating the weapons container moved between the storage position and launch position.
Figure 1A:
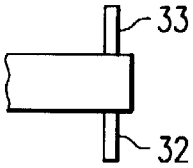
FIG. 1A is a plan view of the crane head.

With reference now to the figures, wherein like or corresponding parts are designated by the same reference numeral, and with specific reference to FIG. 1, there is illustrated a rack system 10 forming a first embodiment of the present invention. The rack system is intended to be mounted on a vehicle 12, such as a truck, having a frame 14, rear axles 16 and a power train and crew accommodations of conventional type (not illustrated).

Mounted on the vehicle 12 is a crane 18 including a rotatable base 20 for rotating the crane about a vertical axis, an inboard arm 22 pivoted to the base 20 for movement about a horizontal axis by a double acting actuator 24 and an outboard arm 26 pivoted to the inboard arm 22 at hinge 28 for movement about a horizontal axis. A second double acting actuator (not illustrated) is positioned within the outboard arm 26 to pivot the arm 26 relative to arm 22 about hinge 28. The end of the outboard arm 26 mounts an electromechanical lift 30 and has an aligned pair of outwardly extending pins 32 and 33 mounted thereon.

Figure 2:
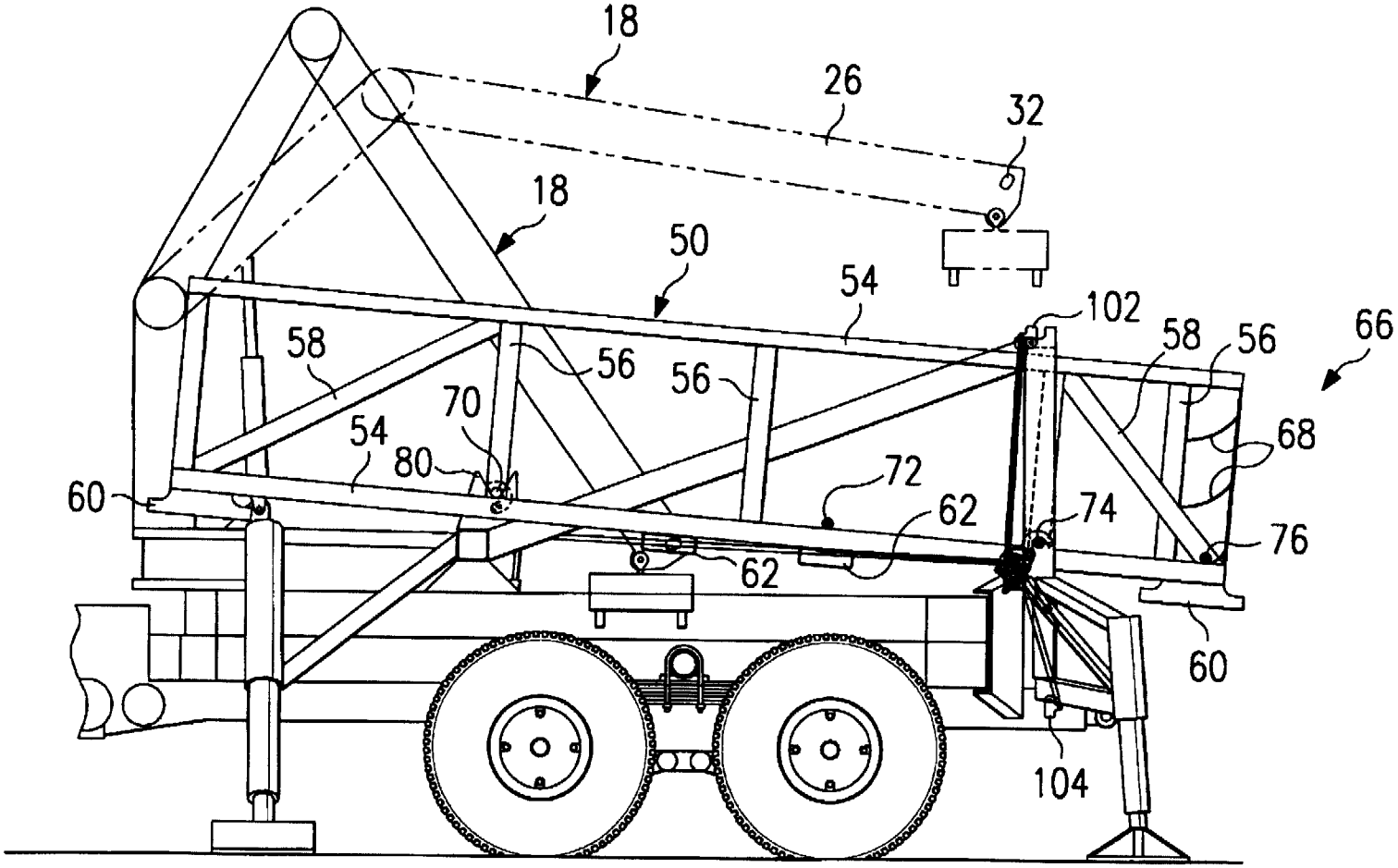
FIG. 2 is a side view of the vehicle system of FIG. 1 with the weapons container in the storage position.
Figure 3:
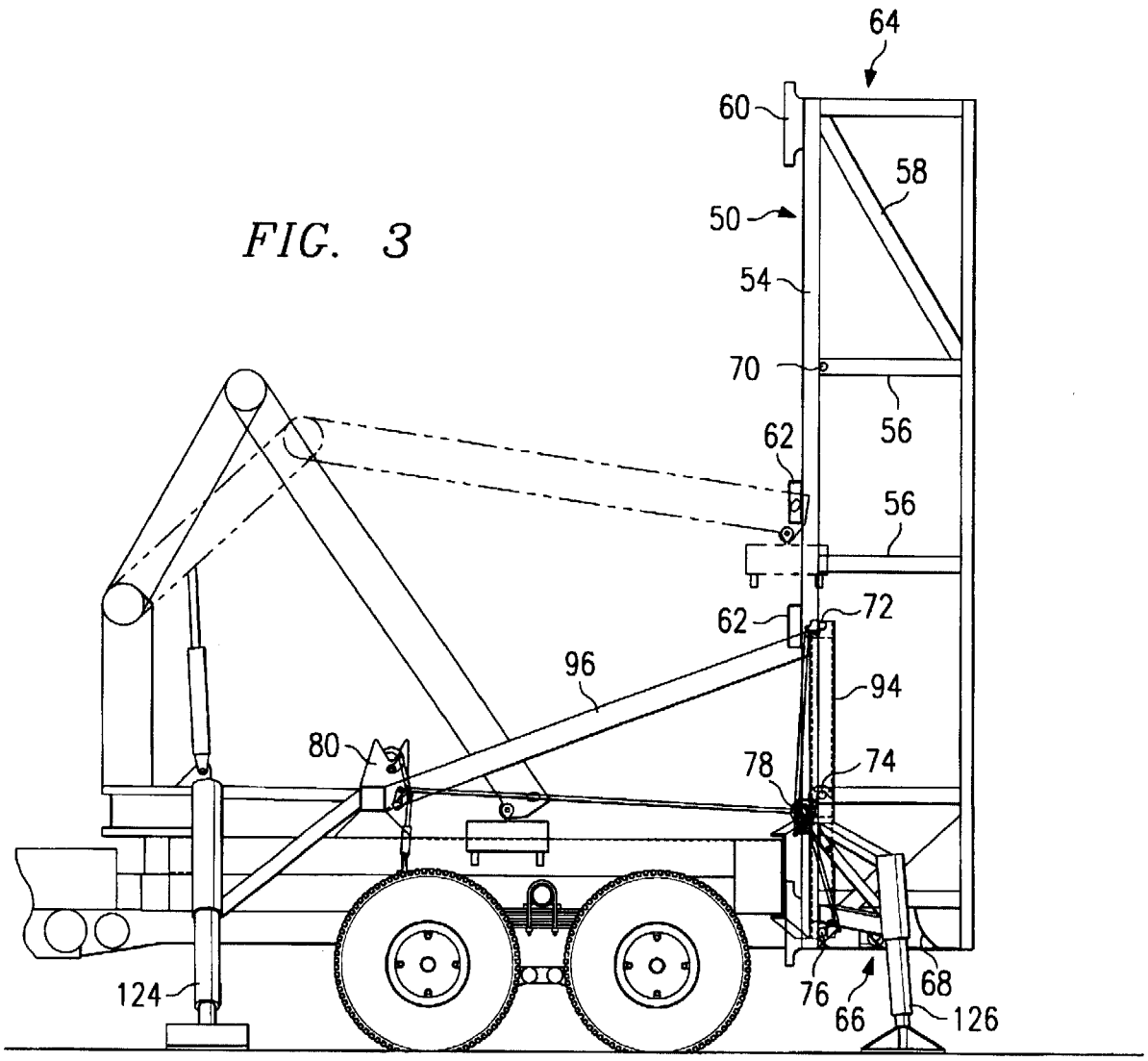
FIG. 3 is a side view of the vehicle system of FIG. 1 illustrating the weapons container in the launch position.
Figure 4:
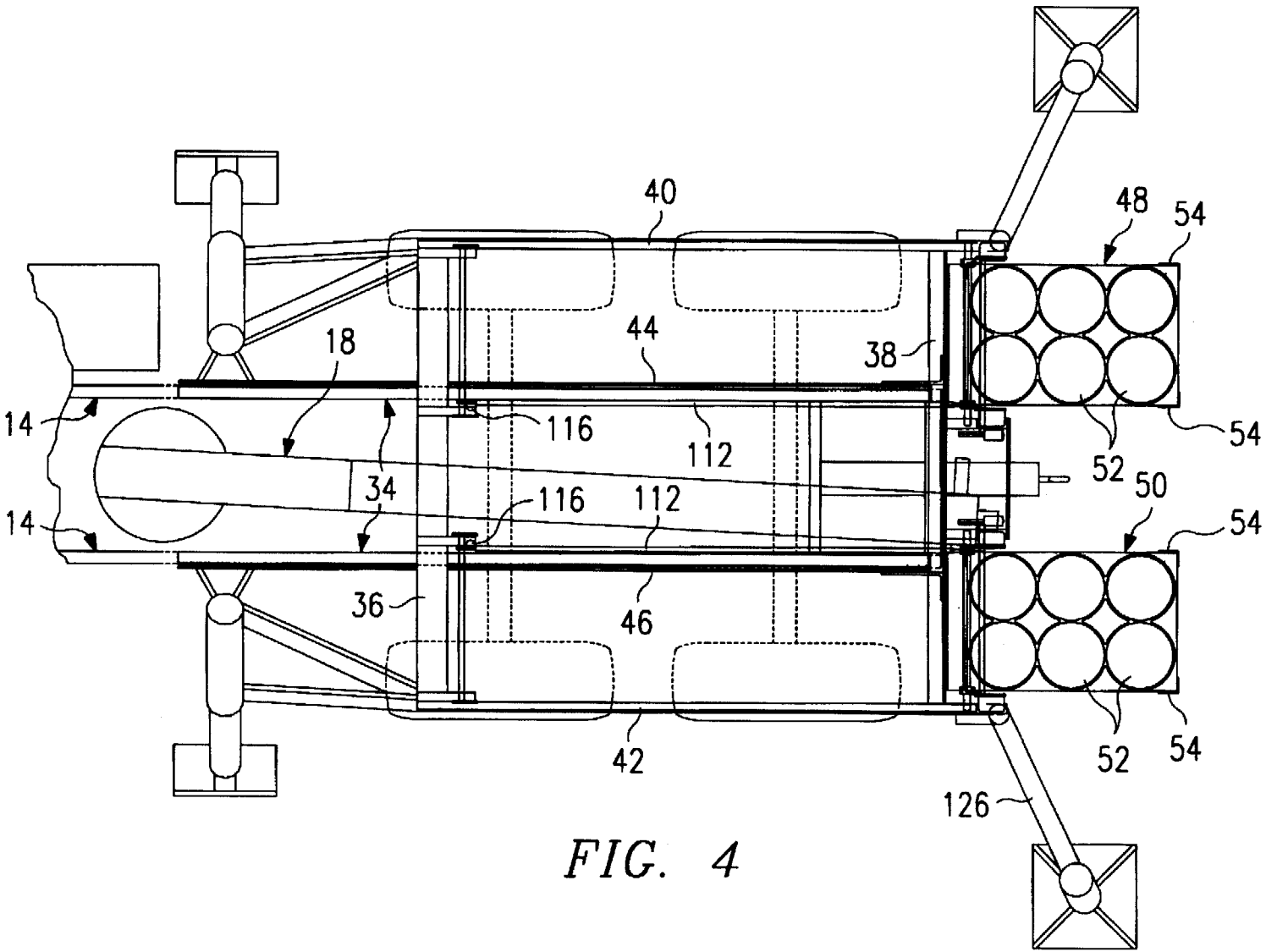
FIG. 4 is a top view of the weapons system of FIG. 1 illustrating the weapons containers in the launch position.
Figure 5:
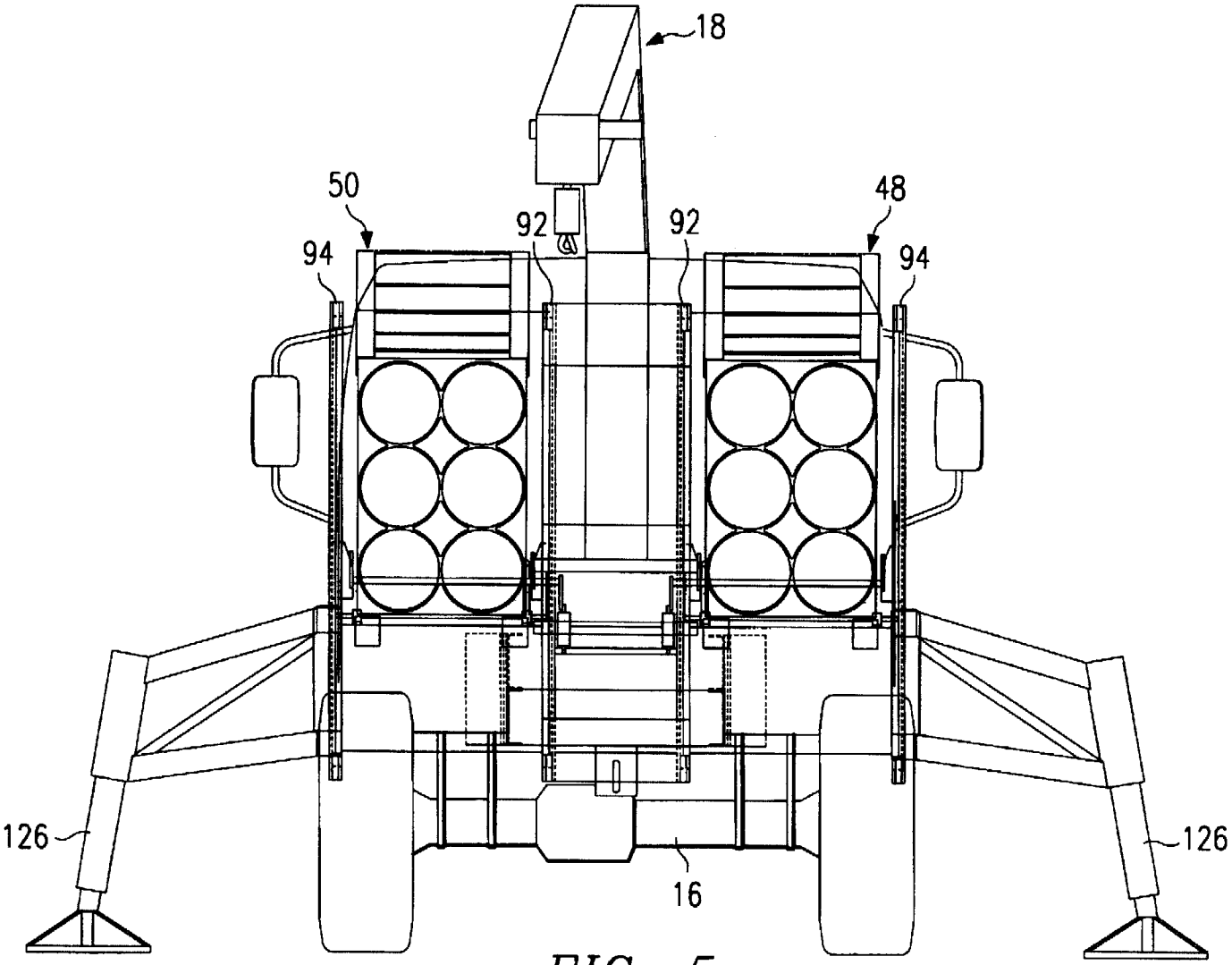
FIG. 5 is a rear view of the vehicle system illustrating the weapons containers in the storage position.
Figure 6:
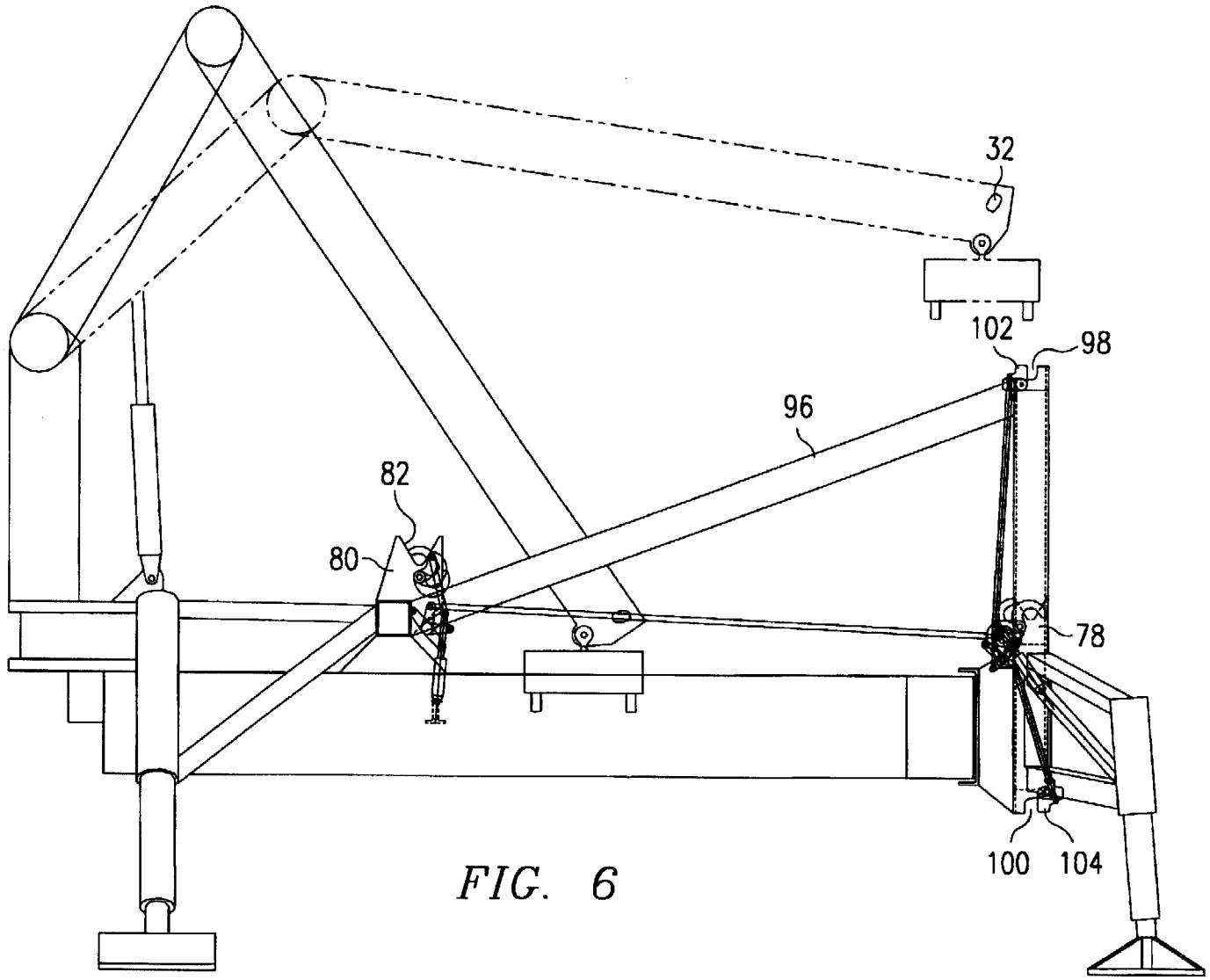
FIG. 6 is a side view of the vehicle system without a weapons container mounted thereon.

As best seen in FIGS. 4 and 6, a subframe 34 is mounted on the frame 14 of the vehicle 12 which includes a forward crossbeam 36, a rear crossbeam 38, outboard horizontal braces 40 and 42 and inboard braces 44 and 46. The subframe 34 is designed to mount a pair of weapons containers 48 and 50 and secure the weapons containers in a storage position for transport by the vehicle, as seen in FIG. 2, and move the weapons containers 48 and 50 to a launch position, where the weapons containers 48 and 50 are oriented vertically, as seen in FIG. 3, with structure to be discussed hereinafter.

Figure 7:
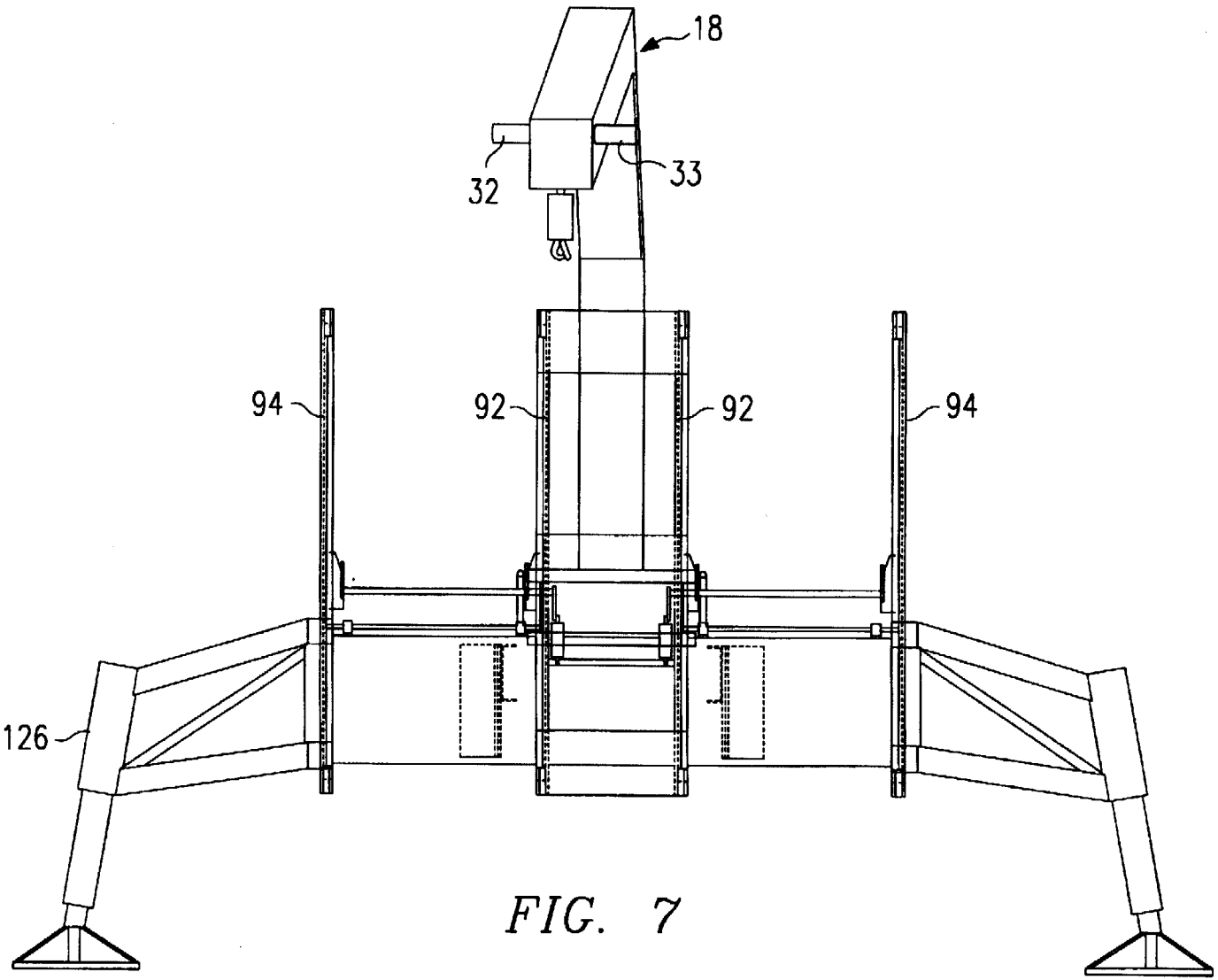
FIG. 7 is an end view of the vehicle system without a weapons container mounted thereon.

As best seen in FIGS. 6 and 7, the subframe 34 also mounts a pair of inboard uprights 92 and a pair of outboard uprights 94 at the rear of the subframe 34 and outboard angled braces 96 which extend from near the upper end of the outboard uprights 94 forward to the forward crossbeam 36.

The weapons containers 48 and 50 have a box-shaped configuration and each hold at least one rocket or missile 52 as seen in FIG. 4. In the design illustrated in the figures, six missiles or rockets are held in each container. The containers have an elongate rectangular shape including elongate frame members 54 interconnected by lateral frame members 56 and angle members 58 to form a rigid structure. Cushion pads 60 and forklift channels 62 are provided to support and lift the containers, and missiles or rockets therein, in transport and storage prior to installation on the vehicle 12. In addition, lifting eyes can be mounted on the containers as well.

Each of the containers has an open first end 64 through which the missiles or rockets are launched. The opposite, second end 66 is generally open, with curved blast deflectors 68 mounted therein which deflect the blast away from the vehicle 12 as the missile or rocket is launched to minimize damage to the vehicle during the launch sequence. The deflectors 68 are formed of suitable material to resist the blast forces, at least for a time sufficient for the launch of the missiles or rockets contained therein, such as steel or stainless steel, ceramics, composites, etc.

Along the sides of the containers 48 and 50 are mounted four pairs of aligned pins, including a pair of forward storage latch pins 70 near the first end 64 of the container, a pair of upper launch latch pins 72 near the center of the container, a pair of pivot latch pins 74 and a pair of lower launch latch pins 76 proximate the second end 66 of the container. The latch pins 74 are positioned along the container between latch pins 72 and 76.

To load a container on the vehicle, the vehicle is driven close to the container, which is lying in a horizontal position supported on the cushion pads 60 on a reload vehicle or on the ground. The crane 18 is activated to move the electromechanical lift 30 onto the container to latch to the container. The crane can then lift the container until the pivot latch pins 74 are positioned immediately above a pair of aligned pivot V-notch blocks 78 mounted to the adjacent inboard upright 92 and adjacent outboard upright 94 and the pair of forward storage latch pins 70 are immediately above a pair of aligned storage V-notch blocks 80 mounted to the forward crossbeam 36 near the forward end of the subframe 34. The crane then lowers the container so that the pins 70 engage the V-notch 82 of blocks 80 and the pins 74 engage the V-notch 82 of the blocks 78 to support the container on the vehicle 12. As will be clear from the figures, as two containers are mounted on each vehicle, identical pairs of blocks 78 and 80 are positioned on opposite sides of the elongate center line of the vehicle for accepting the two containers. Thus, two blocks 80 are used for each container, making for a total of four blocks 80 on system 10. Two blocks 78 are used for each container making for a total of four blocks 78 on system 10.

Figure 8A:
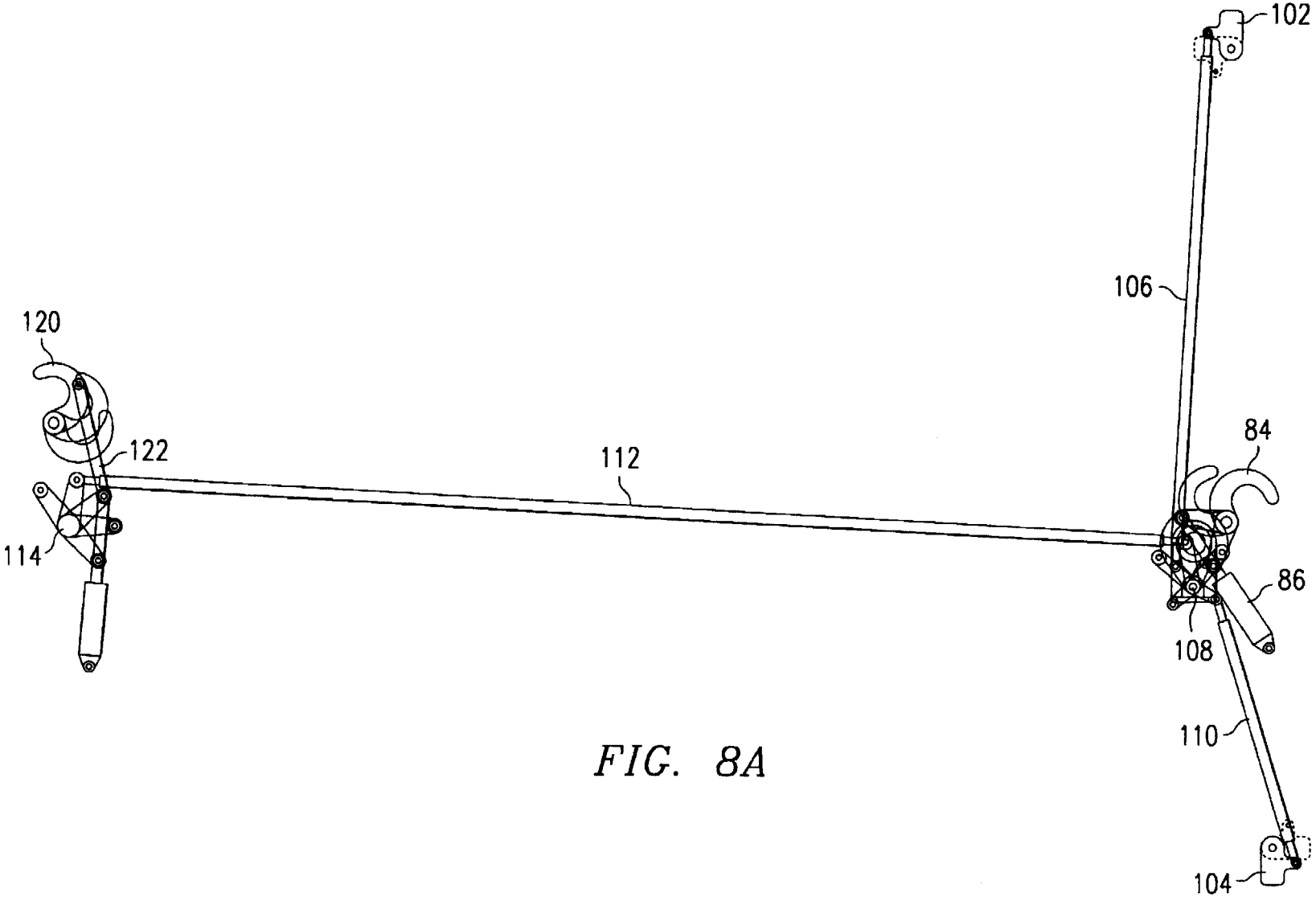
FIGS. 8A, 8B and 8C are side views of the linkage system used in the vehicle.
Figure 8C:
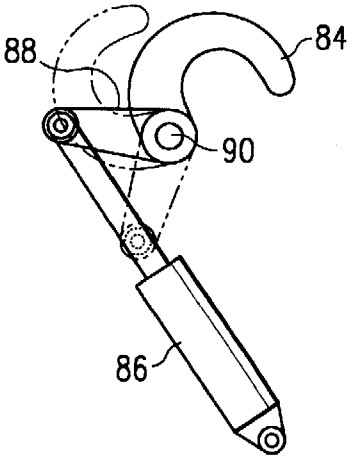
Figure 8B:
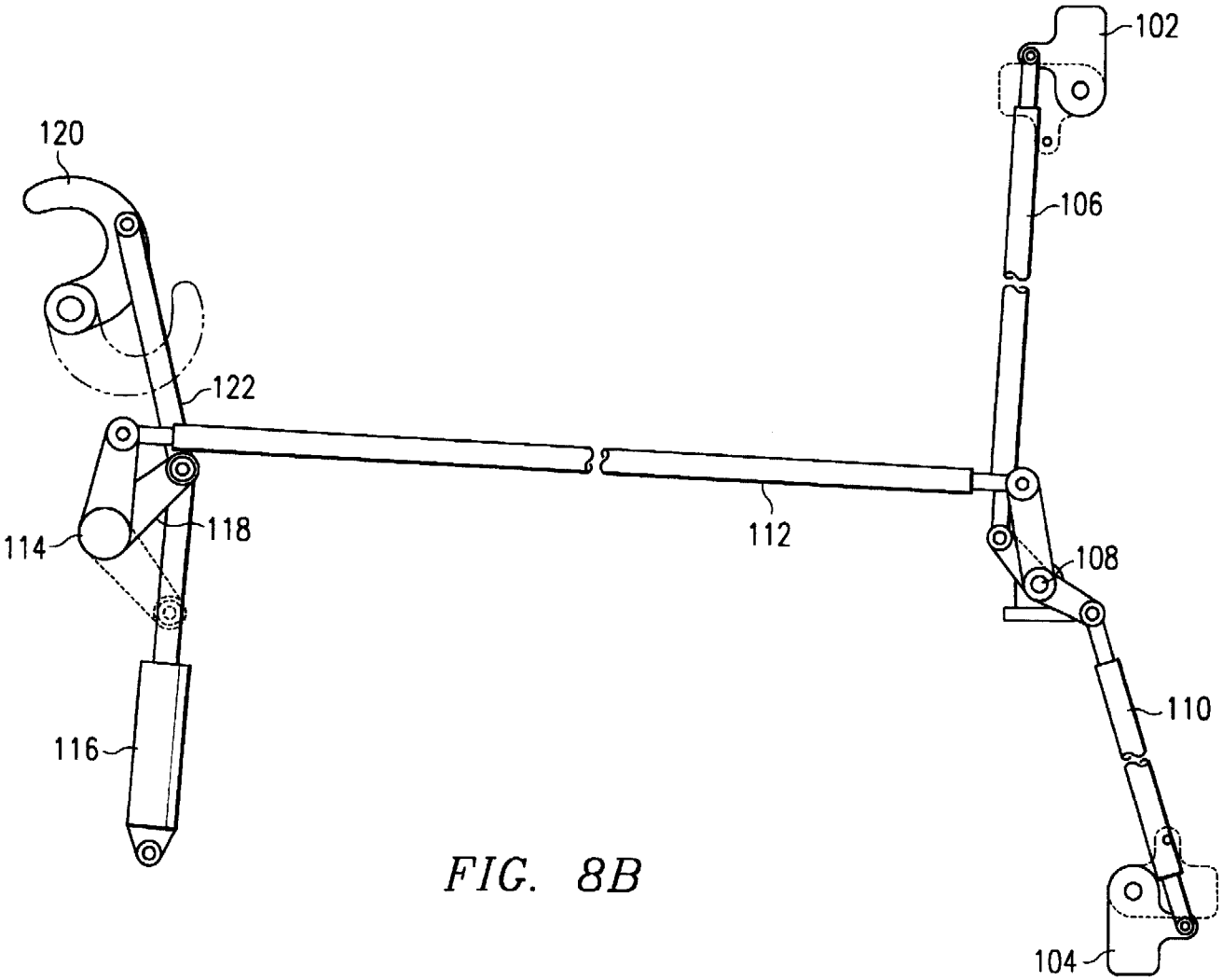
Figure 9:
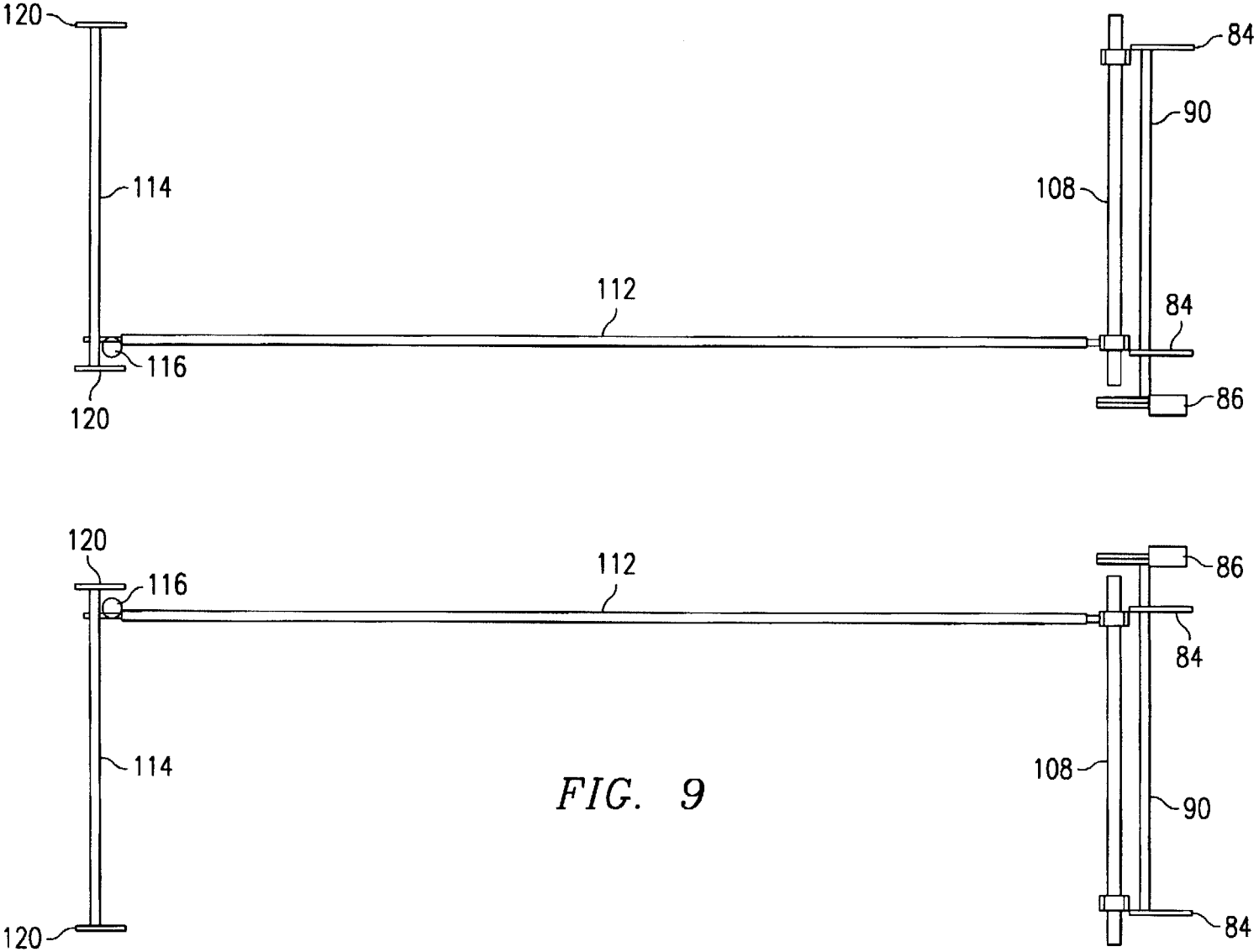
FIG. 9 is a top view of the linkage system.
Figure 10:
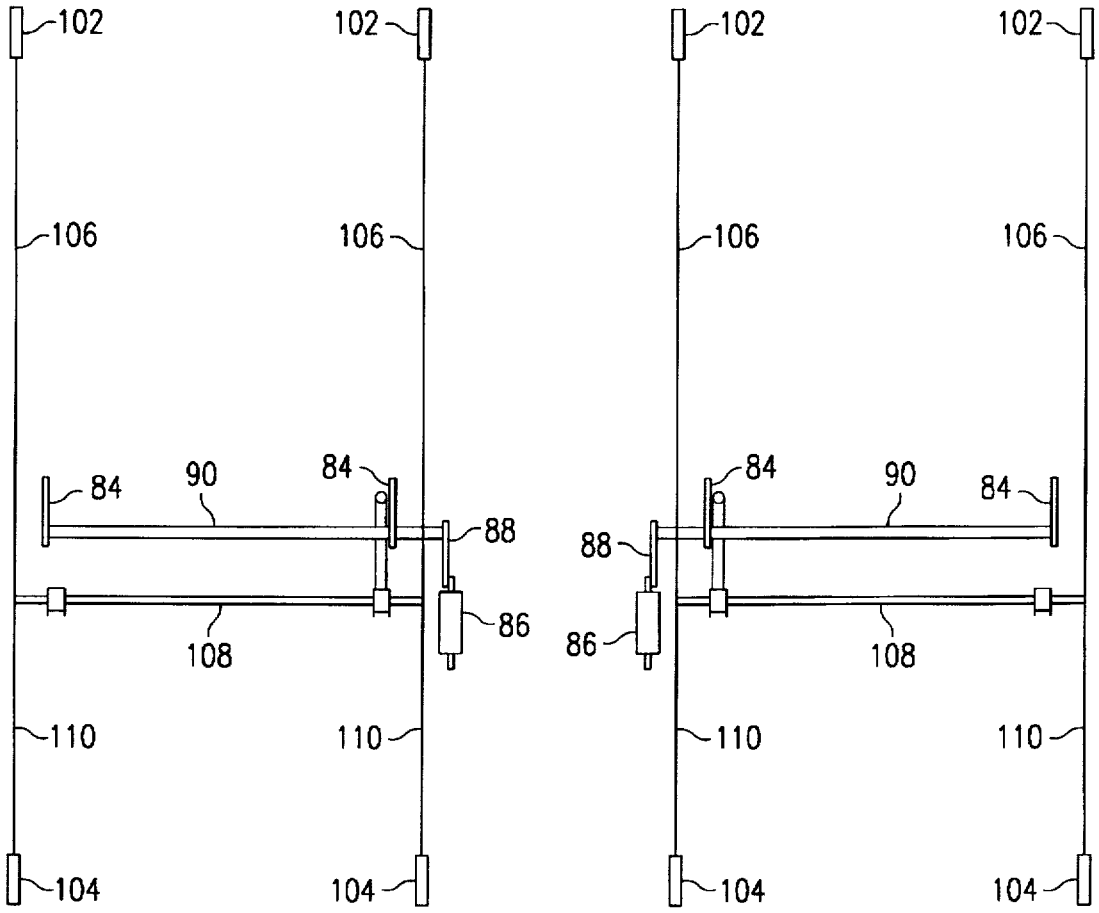
FIG. 10 is an end view of the linkage system.

With reference now to FIG. 8A–C, a pair of rear hold down locks 84 in the form of hooks are pivoted to the inboard upright 92 and outboard upright 94 on each side of the elongate center line of the vehicle, each lock being near one of the blocks 78. The locks 84 are mounted at opposite ends of a bell crank rod 90 (see FIG. 9) which, in turn, is pivoted to the subframe 34. The locks 84 are pivoted to an unlocked position, permitting the pins 74 to move into the V-notches 82 of blocks 78 and then pivoted to the locked configuration, as seen in FIG. 2, where the locks confine the pins 74 in the V-notches 82. The locks are pivoted by a single rear hold down lock actuator 86 for each container operating through a bell crank 88 and the bell crank rod 90. It can be understood that, when the locks 84 are in the locked position, the container is confined on the vehicle for pivotal motion about the axis of the pins 74.

Each of the uprights 92 and 94 have a upper forward facing notch 98 and a lower rearward facing notch 100 to receive a pin 72 or 76, respectively, as a container is moved to the vertical, launch position, as seen in FIG. 6. The vertical sides of each of the notches form stops to engage the pins 72 and 76 so that the container does not pivot beyond the vertical, launch position.

An upper latch block 102 is pivoted at the upper end of each of the uprights 92 and 94 proximate the notches 98. Similar lower latch blocks 104 are pivoted to the uprights near the lower notch 100 thereof. As best seen in FIGS. 8A–C and 9, each of the latch blocks 102 is connected through a tie rod 106 to a rear bell crank 108, while each of the lower latch blocks 104 is connected through a tie rod 110 to the rear bell crank 108. A single tie rod 112 extends from the rear bell crank 108 to a forward bell crank 114. A double acting actuator rotates the forward bell crank 114 through a bell crank arm 118 which, in turn, rotates the rear bell crank 108 through tie rod 112 and pivots the latch blocks 102 and 104 through tie rods 106 and 110.

A forward hold down lock 120 is pivotally mounted to the subframe near each of the storage V-notch blocks 80. In the unlocked position, the pins 70 can enter the V-notch 82 in blocks 80. In the locked position, the locks 120 confine the pins 70 within the V-notch 82 of blocks 80 to secure the container to the subframe. The locks 120 are moved between the locked and unlocked position through links 122 connected to the forward bell crank 114. Thus, the double acting actuator 116 activates the forward locks 120 and blocks 102 and 104 simultaneously.

With reference to FIG. 2, when the container 48 or 50 is initially installed on the vehicle 12, with pins 70 and 74 in the V-notch of blocks 80 and 78 respectively, the actuators 86 and 116 are actuated to move the locks 84 and 120 over the pins 70 and 74 to secure the container on the vehicle for transport. Preferably, the locks 84 and 120 each have a hook configuration with a wedging interior surface moving into wedging contact with the pins to wedge the pins into the V-notches 82 and prevent the container from moving about on the vehicle. In this position, the locks 102 and 104 are pivoted to the blocking configuration, as seen in FIG. 2.

When the container is to be moved to the vertical, launch position, the actuator 116 is actuated in the opposite direction to unlock the pins 70 and unblock the notches 98 and 100. However, the actuator 86 remains actuated to confine the pins 74 to only pivotal motion within the V-notch 82 of the V-notch blocks 78. The crane 18 is then activated so that one of the pins 32 or 33 on the outboard arm 26 on the crane engages one of the fork lift boxes 62 on container 48 or 50. The crane is then actuated to pivot the container toward the vertical position, as seen in FIG. 1, until the pins 72 and 76 contact notches 98 and 100, respectively. The crane is usually operating between the two containers so that the pin 33 would engage container 48 while pin 32 would engage container 50. Alternatively, holes could be formed in either side of the crane near lift 30 to be slipped over one of the pins 70 or 72 to lift a container. In yet another variation, pins 32 and 33 can be made extendable and retractable in the crane head to permit both containers to be raised and lowered together. The crane head would be positioned between the containers with the pins retracted. The pins would then be extended sufficiently to engage both containers for simultaneous lifting or lowering. The pins would then be retracted to release the containers. This variation would permit movement of only a single container by extending just one of the pins.

Subsequently, the actuator 116 is again actuated to move the locks 120 into the locking position and the blocks 102 and 104 into the blocking position, positively securing the container in the vertical, launch position. The crane can then disengage the fork lift box it engaged during lifting, and return to its storage position. With the container in the vertical, launch position, locked thereby by the cooperative action of the pins 72, 74 and 76, the missiles or rockets held therein are ready for launching.

Either container 48 or 50 can be separately moved between the storage position and the launch position as desired.

To assist the stability of the vehicle 12 in preparation for launch, a forward pair of supports 124 can be extended to engage the ground and a rearward pair of supports 126 can be pivoted outboard and deployed into engagement with the ground to provide stability.

While not necessary, the rear of the vehicle frame can also be designed to be contacted by the container 48 or 50 as it moves into the vertical or launch position to provide added support for the container. Also, while the container is illustrated as being moved into a vertical launch position, the advantages of the present invention can be as readily realized for containers which are moved to a launch position off vertical. All that is necessary is to insure the crane holds the container in the launch position for a sufficient interval to pivot the blocks and 104 into the blocking position.

The present invention can be incorporated into the Corp Defense Surface to Air Missiles (CORP SAM) missile launcher which has a "smart" crane included for autonomous operation of reloading the missile containers Missile/Launch Pad Assembly (M/LPA). The vehicle can pull a trailer with reload containers. The present design eliminates the weight, cost and complexity of structures such as hydraulic cylinders to elevate the containers as has been used in the past. Also, a platform is required to secure the containers to the erection cylinder and this platform would have to be structurally adequate to transfer loads from the container to the launcher during missile firings, high wind loads, and road march conditions. This platform also increases costs, weight and complexity of the system, and is eliminated in the present design.

In the present system, by separately moving the containers into the launch position, one of the containers can be in the launch position ready for missile or rocket launch while the other is lowered for reloading. The crane is available for reloading except during the actual pivoting of the container between the storage position and the launch position. As noted, the containers are maintained in the launch position by the blocks 102 and 104.

The pins 70, 72, 74 and 76 would be expected to be formed by bosses about two inches long. The pins 70 would be located at the missile sabot location. The pins 72 would be near the center of gravity of the container.

The locks and blocks are preferably designed with a linkage of over center design driven by self-locking hydraulic cylinders. Thus, the containers will be held in the storage position or the launch position independent of hydraulic pressure or other power source. If vehicle power is lost, the containers will remain secured in their position.

In the launch position, the containers are secured to the subframe at six separate points, the upper two points are near the center of gravity for maximum stability while the lower four points are in the area of maximum load during missile firing. In the storage position, the containers are held as near the subframe as possible to provide the shortest possible load path and lowest center of gravity and profile possible.

Although one embodiment of the invention has been illustrated in the accompanying drawings and described in the foregoing detailed description, it will be understood that the invention is not limited to the embodiment disclosed, but is capable of numerous rearrangements, modifications and substitutions of parts and elements without departing from the spirit and scope of the invention.

I claim:

1. A rack system for supporting a weapons container in a storage position and in a launch position, the weapons container carrying one or more missiles or rockets therein, the weapons container having a first end and a second end, the rack system comprising:

a frame;

a storage engagement structure mounted on the frame to engage the weapons container proximate the first end in the storage position;

a pivot engagement structure mounted on the frame pivotally engaging the weapons container, said pivot engagement structure movable between an engaged position and a disengaged position, the weapons container being removable from the frame when the pivot engagement structure is in the disengaged position;

a launch engagement structure mounted on the frame to engage the weapons container in the launch position proximate the second end of the weapons container; and a crane mounted on the frame to pivot the weapons container about the pivot engagement structure when the pivot engagement structure is in the engaged position between the storage position and launch position.

2. The rack system of claim 1 wherein the pivot engagement structure includes a V-notch block and a lock.

3. The rack system of claim 1 wherein the storage engagement structure includes a V-notch block and a lock.

4. The rack system of claim 1 wherein the crane mounts a lifting mechanism to lift the weapons container onto the frame.

5. The rack system of claim 1 further including a vehicle, the frame mounted on the vehicle.

6. The rack system of claim 1 wherein the weapons container has at least one blast deflector at the second end thereof.

7. A rack system for supporting a weapons container in a storage position and in a launch position, the weapons container carrying one or more missiles or rockets therein, the weapons container having a first end and a second end, the rack system comprising:

a frame;

a storage engagement structure mounted on the frame to engage the weapons container proximate the first end in the storage position;

a pivot engagement structure mounted on the frame pivotally engaging the weapons container;

a launch engagement structure mounted on the frame to engage the weapons container in the launch position proximate the second end of the weapons container;

a crane mounted on the frame to pivot the weapons container about the pivot engagement structure between the storage position and launch position; and a second launch engagement structure to engage the weapons container in the launch position.

8. A rack system for supporting a weapons container in a storage position and in a launch position, the weapons container carrying one or more missiles or rockets therein, the weapons container having a first end and a second end, the rack system comprising:

a frame;

a storage engagement structure mounted on the frame to engage the weapons container proximate the first end in the storage position;

a pivot engagement structure mounted on the frame pivotally engaging the weapons container;

a launch engagement structure mounted on the frame to engage the weapons container in the launch position proximate the second end of the weapons container;

a crane mounted on the frame to pivot the weapons container about the pivot engagement structure between the storage position and launch position; and the storage engagement structure having a lock movable between a locked position and an unlocked position and the launch engagement structure having a block movable between a blocked position and an unblocked position, the rack system further including a mechanism to move the lock and block to the locking and blocking position simultaneously.

9. A rack system for supporting a weapons container in a storage position and in a launch position, the weapons container carrying one or more missiles or rockets therein, the weapons container having a first end and a second end, the rack system comprising:

a frame;

a storage engagement structure mounted on the frame to engage the weapons container proximate the first end in the storage position;

a pivot engagement structure mounted on the frame pivotally engaging the weapons container;

a launch engagement structure mounted on the frame to engage the weapons container in the launch position proximate the second end of the weapons container;

a crane mounted on the frame to pivot the weapons container about the pivot engagement structure between the storage position and launch position; and the weapons container having four sets of pins extending therefrom, a first set of said pins engaging the storage engagement structure, a third set of said pins engaging the pivot engagement structure and the second and fourth set of said pins engaging the launch engagement structure.

10. A method for moving a weapons container between a storage position and a launch position, comprising the steps of:

positioning the weapons container on a frame at a storage engagement structure and a pivot engagement structure;

locking the weapons container to the frame with the storage engagement structure and pivot engagement structure in the storage position;

unlocking the weapons container from the frame at the storage engagement structure;

pivoting the weapons container about the frame at the pivot engagement structure to the launch position; and removing the weapons container from the frame by unlocking the weapons container from the frame at the pivot engagement structure.

11. The method of claim 10 wherein the step of pivoting the weapons container includes the step of operating a crane mounted on the frame to engage the weapons container to pivot the weapons container to the launch position.

12. The method of claim 11 further comprising the step of loading the weapons container on the frame with the crane.

13. The method of claim 11 further comprising the step of removing the weapons container from the frame with the crane.

14. The method of claim 10 further comprising the step of loading the weapons container onto V-notch blocks in the storage engagement structure and pivot engagement structure.

15. The method of claim 10 further including the step of directing exhaust gases from missiles or rockets contained in the weapons container with at least one blast deflector mounted in the weapons container.

16. The method of claim 10 further comprising the step of mounting the frame on a vehicle.

17. A method for moving a weapons container between a storage position and a launch position, comprising the steps of;

positioning the weapons container on a frame at a storage engagement structure and a pivot engagement structure;

locking the weapons container to the frame with the storage engagement structure and pivot engagement structure in the storage position;

unlocking the weapons container from the frame at the storage engagement structure;

pivoting the weapons container about the frame at the pivot engagement structure to the launch position; and engaging the weapons container with a launch engagement structure in the launch position;

blocking the weapons container in the launch position with the launch engagement structure.

18. The method of claim 17 wherein the step of blocking the weapons container in the launch position further includes the step of blocking the weapons container at positions above and below the pivot engagement structure.

19. A method for moving a weapons container between a storage position and a launch position, comprising the steps of:

positioning the weapons container on a frame at a storage engagement structure and a pivot engagement structure;

locking the weapons container to the frame with the storage engagement structure and pivot engagement structure in the storage position;

unlocking the weapons container from the frame at the storage engagement structure;

pivoting the weapons container about the frame at the pivot engagement structure to the launch position; and independently positioning, locking, unlocking and pivoting a second weapons conger between a storage position and a launch position independent of the first weapons container.

20. A rack system for supporting a weapons container in a storage position and a launch position, the weapons container carrying one or more missiles or rockets therein, comprising:

a frame;

at least one pivot latch pin block;

at least one forward storage latch pin block;

at least one launch latch pin block;

a hold down lock movable between a locked position and an unlocked position relative to the pivot latch pin block;

a storage latch lock movable between a locked position and an unlocked position relative to the storage latch pin lock; and a launch latch lock movable between a locked position and an unlocked position relative to the launch latch pin block.

21. The apparatus of claim 20, wherein the storage latch lock and the launch latch lock move to the locked position simultaneously.

22. The apparatus of claim 20, wherein the storage latch pin block is a forward latch pin block, the launch latch pin block including a lower launch latch pin block and a upper launch latch pin block.

* * * * *